US005172903A

United States Patent [19]

Haneda et al.

[11] Patent Number: 5,172,903

[45] Date of Patent: Dec. 22, 1992

[54] PAPER FEED CASSETTE

[75] Inventors: Satoshi Haneda; Hisao Satoh; Tadayoshi Ikeda; Shizuo Morita; Masakazu Fukuchi, all of Hachioji, Japan

[73] Assignee: Konica Corporation, Tokyo, Japan

[21] Appl. No.: 765,569

[22] Filed: Sep. 25, 1991

[30] Foreign Application Priority Data

Sep. 28, 1990 [JP] Japan ..... 2-262403
Oct. 11, 1990 [JP] Japan ..... 2-272550

[51] Int. Cl.[5] ..... B65H 1/00
[52] U.S. Cl. ..... 271/171; 271/145
[58] Field of Search ..... 271/171, 145

[56] References Cited

U.S. PATENT DOCUMENTS 4,579,333 4/1986 Aoki ..... 271/171 X
4,607,834 8/1986 Dastin ..... 271/171
4,874,160 10/1989 Yamamoto ..... 271/171 X
4,907,792 3/1990 Washiashi et al. ..... 271/171 X

FOREIGN PATENT DOCUMENTS 0130834 8/1983 Japan ..... 271/171
0212331 12/1984 Japan ..... 271/171
0203033 9/1986 Japan ..... 271/171
0046822 2/1987 Japan ..... 271/171
0056224 3/1987 Japan ..... 271/171
0315425 12/1988 Japan ..... 271/171

*Primary Examiner*—H. Grant Skaggs
*Assistant Examiner*—Carol Lynn Druzbick
*Attorney, Agent, or Firm*—Jordan B. Bierman

[57] ABSTRACT

The invention provides a sheet feed cassette for holding various sizes of sheets to be fed to an image recording apparatus in a feed direction. The cassette comprises a first casing having a sheet placement area, and a second casing slidably connected to the first casing for expanding the area. The first casing is detachably mounted on the image recording apparatus.

5 Claims, 10 Drawing Sheets

PAPER FEED CASSETTE

BACKGROUND OF THE INVENTION

The present invention relates to a paper feed cassette for sheets used in an image recording apparatus such as a copier, facsimile, printer, or the like.

A plurality of papers used in the image recording apparatus is loaded in a paper feed cassette which is usually made to match a specific paper size. The paper feed cassette is mounted on the recording apparatus, and the paper is automatically pulled out sheet by sheet from the cassette by a paper feed means such as paper feed rollers and the like provided in the image recording apparatus.

Generally, in a recording apparatus which can record on papers of different sizes, a plurality of paper feed cassettes, each being used for one paper size, is mounted on the side or the front of the apparatus main body so that papers can be fed selectively. However, the recording apparatus in which papers with multiple sizes are fed requires a plurality of paper feeds and, thus, the apparatus becomes complicated and its cost is increased. Furthermore, its overall height is increased, resulting in large size.

In order to avoid these problems, there has been used a recording apparatus in which a universal paper feed cassette is detachably provided to a paper feed device in the apparatus main body. The universal paper feed cassette is a cassette in which a position regulation member can be set in various positions so that papers with different sizes can be loaded in the cassette.

The above-described universal paper feed cassette has a casing which can accept the paper of the largest size, and it is provided with a position regulation member with which the papers with different sizes can be positioned, and therefore, the casing becomes large in size. For this reason, a portion of the paper feed cassette protrudes from the side or front of the main body of the recording apparatus when the universal paper feed cassette is mounted on the apparatus, resulting in the used for a large installation space and creating an obstruction in operation. Furthermore, when using small or medium-sized papers (for example, A4 size, B5 size, or the like) which are frequently used in such apparatus, it is undesirable for the large-sized universal paper feed cassette to protrude from the apparatus. Especially, when the paper feed cassette protrudes to a great extent from the front of the apparatus, it causes not only the obstruction in the operation, but also the risk of damage to the cassette caused by an impact. When the paper feed cassette is covered by enlarged enclosures of the recording apparatus in order to reduce the amount of protrusion of the paper feed cassette, the recording apparatus has a disadvantage of a large size.

SUMMARY OF THE INVENTION

An object of the present invention is to solve the above-described problems of the conventional paper feed cassette, and to provide a paper feed cassette in which, when using the cassette for papers of frequently used sizes, the protrusion of the cassette from the front of the recording apparatus main body or from the side thereof is minimized and, when a large-sized paper is fed, the paper placement area can be easily enlarged so that the large-sized paper can be loaded.

In order to accomplish the above-described objects a paper feed cassette of the present invention comprises: a first casing which has a paper placement area capable of holding the smallest-sized paper and a second casing which is movably connected to the first casing and is capable of holding the large sized paper by enlarging the paper placement area, in a universal type paper feed cassette which can hold papers of various sizes by regulating their positions and can be mounted on a paper feed device.

In an embodiment of the paper feed cassette of the invention, the leading edge regulator, which regulates the downstream side of the paper, is provided on the first casing, and a trailing edge regulator which regulates the upstream side of the paper is provided on the second casing.

Another embodiment of the cassette of the present invention comprises: a first casing which can hold at least the smallest-sized paper and can be mounted on the paper feed device; a second casing which is connected to the first casing and is movable in the direction of the paper feed, a first moving device for moving width regulation plates in the perpendicular direction to the paper feed direction and for arranging the paper width in the first casing; and a second moving device which moves the second casing; in the paper feed direction in cooperation with the first moving device in a universal type paper feed cassette which can contain papers of various sizes including a large size and a small size by regulating to be positioned, and can be mounted on a paper feed device. When either one of the width regulation plate or the second casing is moved over a predetermined length, the above-described first moving device and the second moving device are moved in cooperation with each other so that the second casing or the width regulation plate are moved over another predetermined length.

In another embodiment of the paper feed cassette, the paper placement area formed between the first casing and second casing is determined so that when the width regulation plate is set for one dimension of a standard size paper, the second casing will be set for the other dimension of the paper.

Further, the above-described paper feed cassette can further comprise a first moving device having a first rack gear and a first pinion gear engaging the first rack gear, a second moving device having a second rack gear and a second pinion gear engaging the second rack gear. The first and the second pinion gears have a common axis of rotation, and their gear ratio is determined based on the desired relative movement of the width regulation plates and the second casing.

Furthermore, the paper feed cassette of the present invention can comprise a paper size indicator on the side walls of the first casing or the second casing; and a detector can be provided in the paper feed device in the apparatus thereby the movement of the indicator based on the movement of the second casing is detected by the detector so that the size of paper loaded in the cassette can be determined.

BRIEF DESCRIPTION OF THE DRAWINGS

FIG. 1 (B) and FIG. 2 (B) are central sectional views, and FIG. 1 (C) and FIG. 2 (C) are side views;

DETAILED DESCRIPTION OF THE PREFERRED EMBODIMENT

Figure 9:
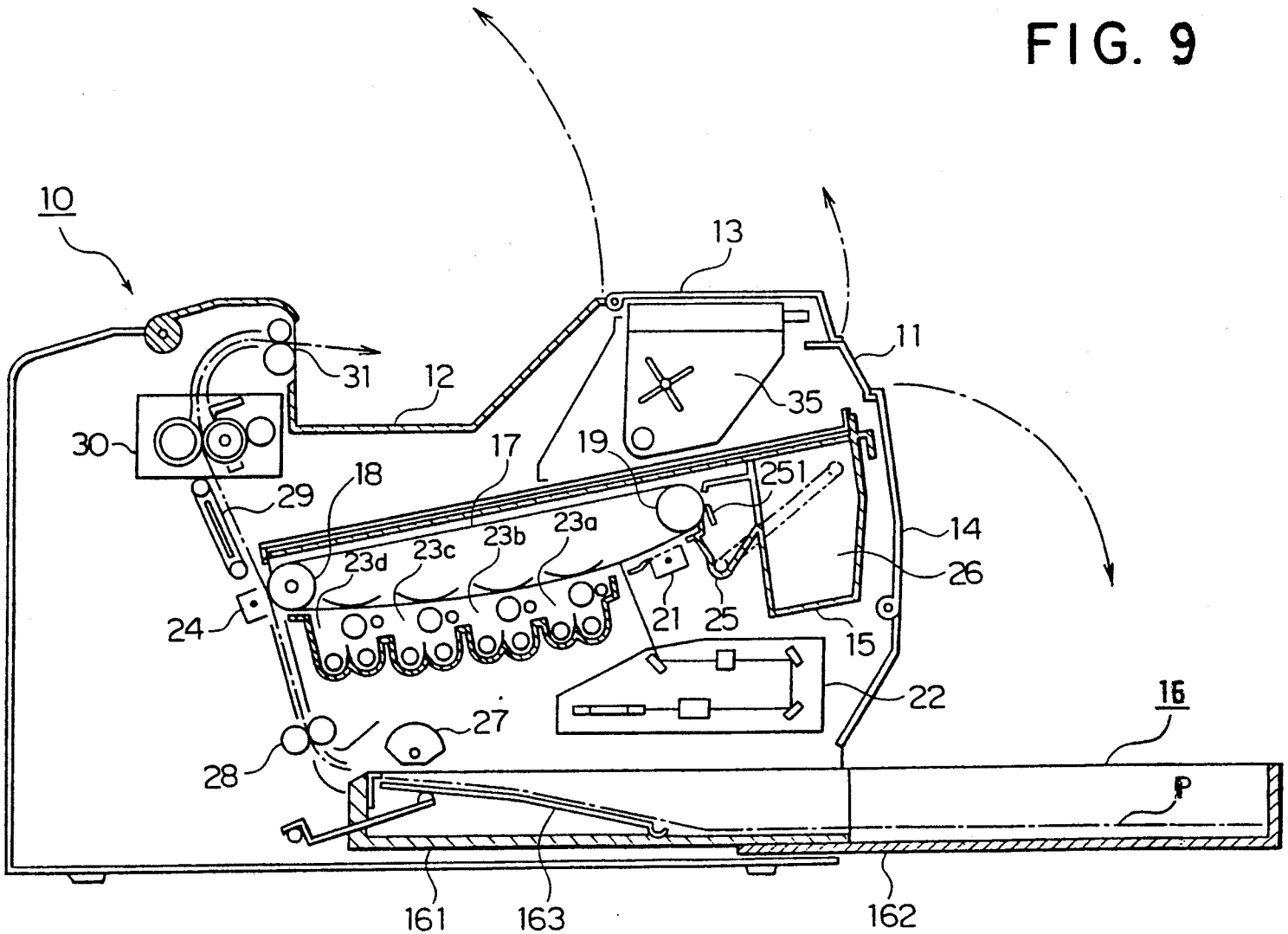
FIG. 9 is a sectional view of a color printer on which the paper feed cassette of the present invention is mounted.
Figure 10:
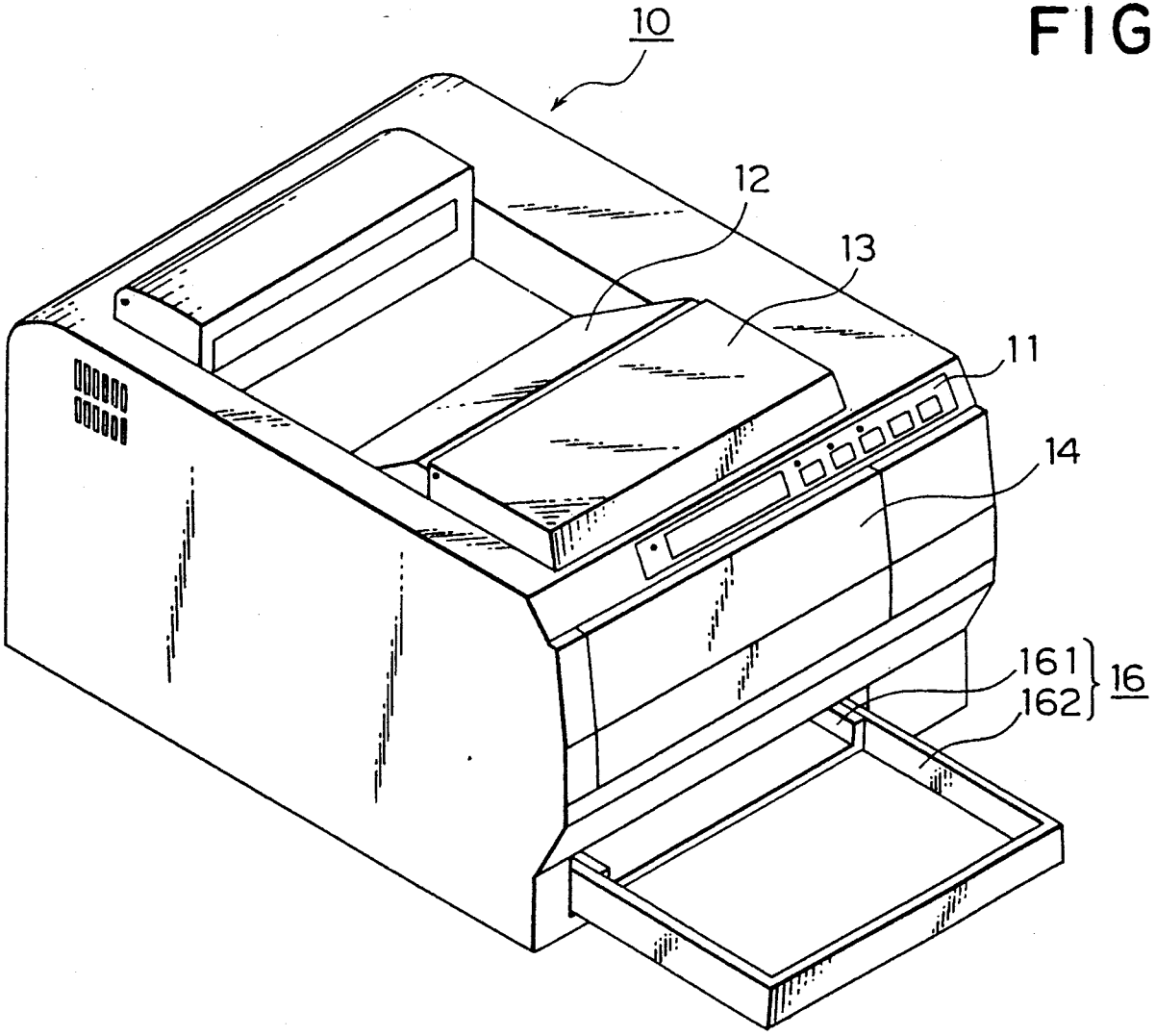
FIG. 10 shows a perspective view thereof.

FIG. 9 shows the main sectional view from the left side of a color printer on which the paper feed cassette of the present invention can be mounted. FIG. 10 shows a corresponding perspective view. Apparatus main body 10 is enclosed by operation panel 11 on its front surface, upper cover (an upper lid member) 12, which can be opened and closed, toner supply cover 13, front cover 14, and the like. Detachable process cartridge 15 and paper feed cassette 16 are provided on the apparatus main body.

Process cartridge 15 comprises photoreceptor belt 17, developing units 23, charger 21, cleaning unit 25. Photoreceptor belt 17, which is an image carrier, is coated with a photosensitive layer such as an organic photoconductor layer (OPC) on its surface and Belt 17 is stretched between driving roller 18 and driven roller 19 for clockwise rotation. A charging means, an exposure means, a developing means, a transfer means, and a cleaning means are provided around photoreceptor belt 17. Charging means 21 can be a conventional charger such as a corona charger, or a Scorotron charger.

The developing means comprises a plurality of developing units 23*a*, 23*b*, 23*c* and 23*d* in which toners (developing agents) of different colors such as yellow, magenta, cyan, and black are contained respectively. These developing units 23*a*–23*d* develop the latent image on photoreceptor belt 17 and form a visible toner image by, in this case, the non-contact development.

The cleaning blade of cleaning means 25 is kept apart from the surface of photoreceptor belt 17 during the image forming process, and closely contacts the surface of photoreceptor belt 17 with pressure to clean it only after transferring the toner image onto transfer material P. Toner collecting box 26 receives the residual toner on photoreceptor belt 17 which is removed by cleaning means 25.

In the present example, processing units forming the above-described image forming portion of a printer such as photoreceptor belt 17, charger 21, developing units 23*a* through 23*d* in which toner of each color is contained respectively, cleaning means 25, and toner collecting box 26 are integrated into process cartridge 15 as a unit, which can be detachably mounted on apparatus main body 10. When the process cartridge 15 is mounted on the main body to form images, the exposure means, transfer means and other elements are positioned around photoreceptor belt 17.

The exposure means is semiconductor laser-writing optical system unit (hereinafter, called an optical system unit) 22, which exposes the surface of photoreceptor belt 17 charged by charger 21 and forms a latent image thereon. The transfer means transfers the toner image formed on photoreceptor belt 17 to transfer material P by transfer unit 24, which may be a transfer corona discharger.

Figure 1A:
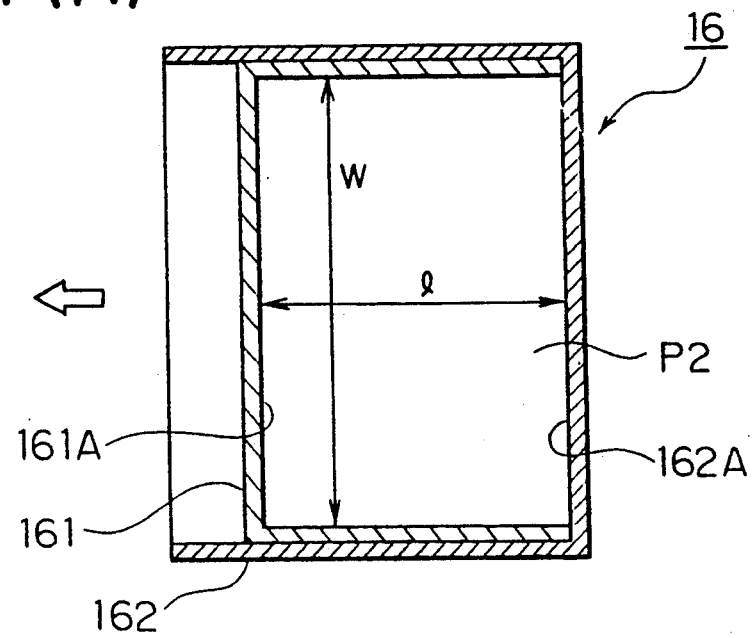
FIG. 1 (A) and FIG. 2 (A) are plan views which show the example of a paper feed cassette of the present invention.
Figure 1B:
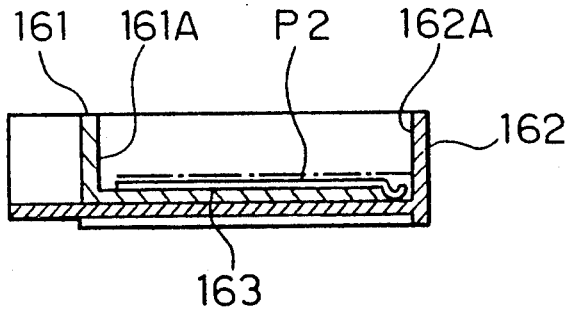
Figure 1C:
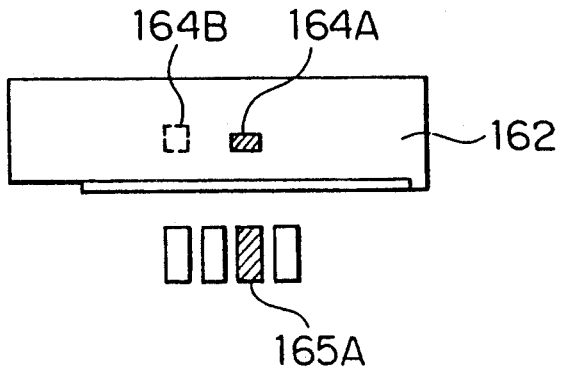

FIG. 1 and FIG. 2 show an embodiment cf the paper feed cassette of the present invention. FIG. 1(A) shows a plan view of a paper feed cassette which is adjusted to accept small papers, FIG. 1(B) shows its central sectional view, and FIG. 1(C) shows its side view.

Paper feed cassette 16 of the present invention has a two-piece structure, and comprises first casing 161 having a paper placement area capable of holding the smallest-sized paper (for example, A4 sized-paper) and second casing 162 which can hold a large sized-paper (for example, A3 sized-paper) by extending the paper placement area through slidable connection with first casing 161. Movable bottom plate 163 is slidably supported on the bottom portion of first casing 161.

First casing 161 comprises a box, the upper surface and the right side of which are open; and has a lateral width W in terms of the inside dimensions is set slightly larger than the width of small sized-paper P2 (for example, the width of A4 sized-paper, 297 mm) to be loaded therein. Length l in terms of the inside dimensions is slightly longer than the length of small sized-paper P2 (for example, the length of A4 sized-paper, 210 mm) to be loaded therein. An inside wall facing toward the direction of the paper feed of first casing 161 has a leading edge regulator 161A against which the leading edge of the paper is aligned. An inside wall facing toward the upstream direction of the paper feed of second casing 162 has trailing edge regulator 162A which contacts the trailing edge of the paper to align it.

Small-sized paper P2 (for example, A4 sized-paper) can be loaded in the inside dimensions W and l of the paper feed cassette shown in FIG. 1 wherein first casing 161 and second casing 162 are combined to form a closed casing. Paper feed cassette 16 thus structured is mounted on the paper feed portion of the image recording apparatus.

Figure 2A:
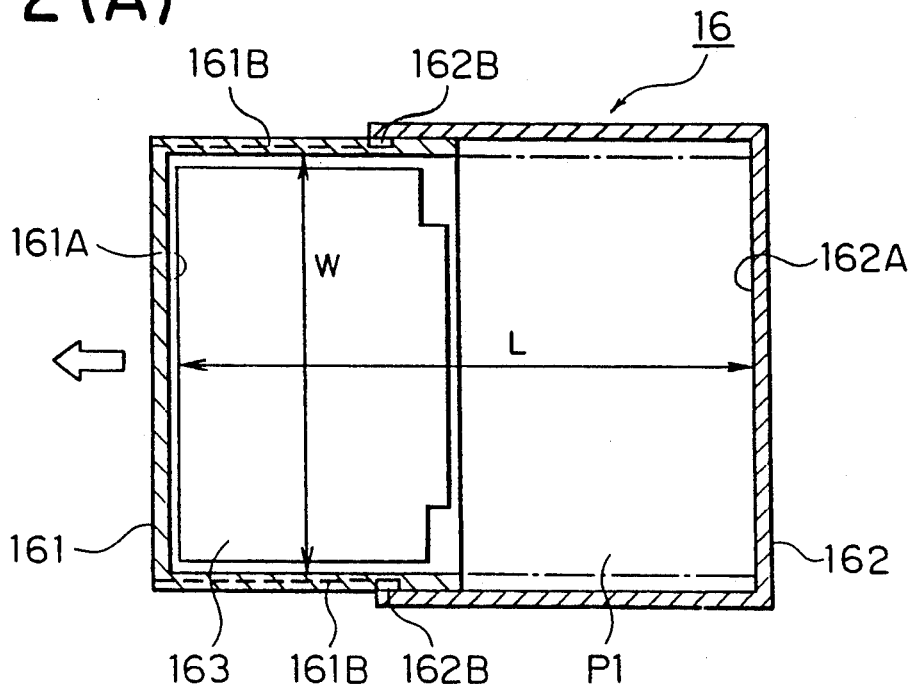
Figure 2B:
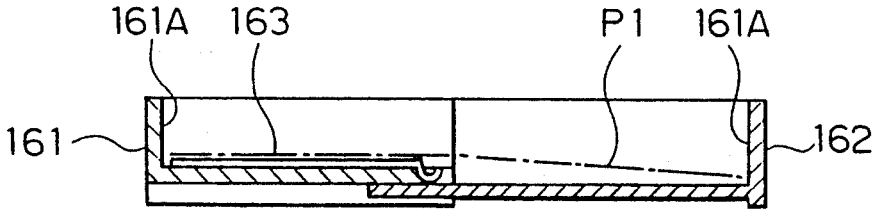
Figure 2C:
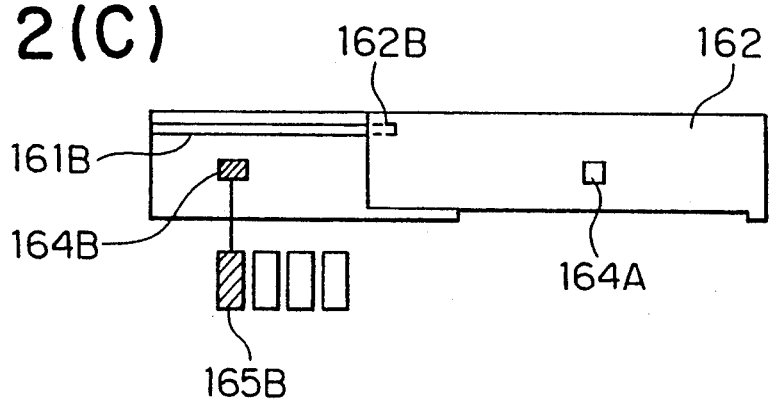

FIG. 2(A) shows a plan view of the paper feed cassette such that large sized-paper can be loaded, FIG. 2(B) shows its central sectional view, and FIG. 2(C) shows its side view. Groove portions 161B formed on both sides of first casing 161, engage claw portions 162B of second casing 162 so that the claw portions may slide along the groove portions. When second casing 162 is pulled out until an end of upper groove portion 161B comes into contact with claw portion 162B and stops, the paper placement area is enlarged and formed into the shape shown in FIG. 2. Large-sized paper P1 having the length L can be loaded therein. After replenishing or changing paper P2, the casing is mounted on the paper feed portion of the image recording apparatus.

Expandable universal paper feed cassette 16 in which both of large sized-paper of A3 and small-sized paper of A4 which having the same width W and different lengths (L and l) can be loaded by regulating the positions of the leading edge and the trailing edge has been explained above. However, the present invention can also be applied to a universal paper feed cassette in which B4 and B5 sized-papers in JIS-B system can be loaded. The present invention can also be applied to a universal paper feed cassette in which papers of other standards such as letter size paper (8.5 inches ×11 inches) and legal size paper (8.5 inches ×14 inches) in the U.S.A. paper size standards can be loaded.

Referring to FIG. 1(C) and FIG. 2(C), indication plates for paper size indication (for example, reflecting plates) 164A and 164B are affixed on both sides of first casing 161. On the other hand, sensors for paper size detection (for example, reflection type photosensors) 165A, 165B are fixed on the cassette receive portion of the paper feed portion of the image recording apparatus.

When paper feed cassette 16, which holds small-sized paper P2 shown in FIG. 1(C) is mounted on the cassette receiving portion, size indicating plate 164A, affixed to the second casing, is detected by second sensor 165A, and the presence of small-sized paper is detected thereby. The proper paper size (for example, A4) can be displayed on operation panel 11. At this time, size indicating plate 164B, on casing 161 is not detected because it is covered by the side wall of second casing 162.

When the paper feed cassette shown in FIG. 2(C), which holds large-sized paper P1 shown in FIG. 2(C) is mounted on the cassette receiving portion, size detection plate 164B affixed to the first casing is detected by sensor 165B, and the presence of large-sized paper is detected thereby. The paper size (for example, A3) can be displayed on operation panel 11.

In the same way as the foregoing, for a combination paper feed cassette for various sizes of papers, appropriate size indicating plates can also be provided, and the paper sizes can be identified and displayed by a plurality of sensors. For example, when four sensors are placed in parallel, 15 kinds of papers ($2^4-1=15$) can be identified. The detected paper size can be transmitted to the image recording apparatus for any other desired function.

A universal paper feed cassette which is used for papers with the same width W (A3 and A4, B4 and B5, legal size and letter size, etc.) has been described above. However, the present invention can be applied also to a universal paper feed cassette which can hold papers having different widths W and lengths L. (FIG. 3)

Figure 3:
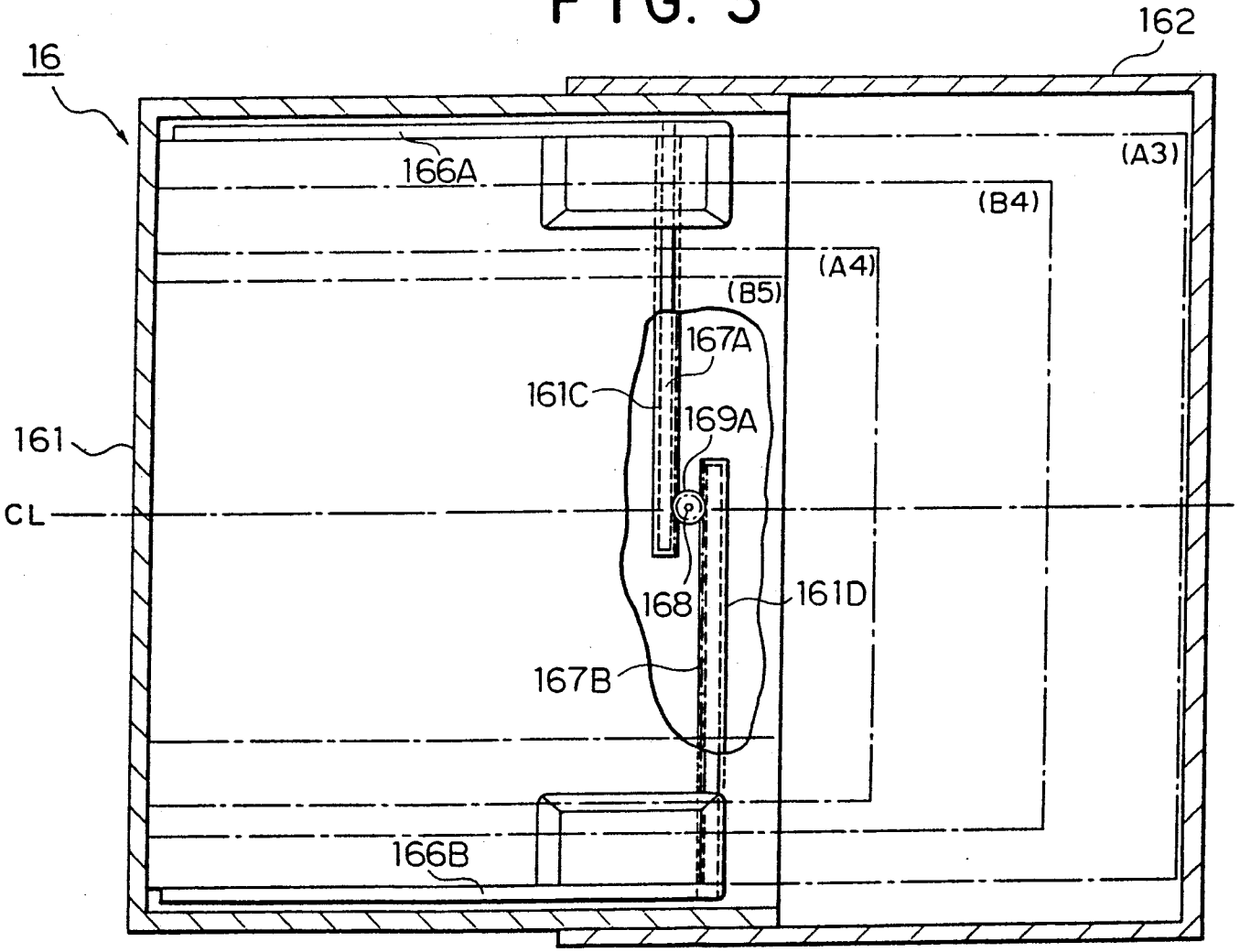
FIG. 3 and FIG. 4 show respectively plan views of two other embodiments of the paper feed cassette of the present invention.
Figure 4:
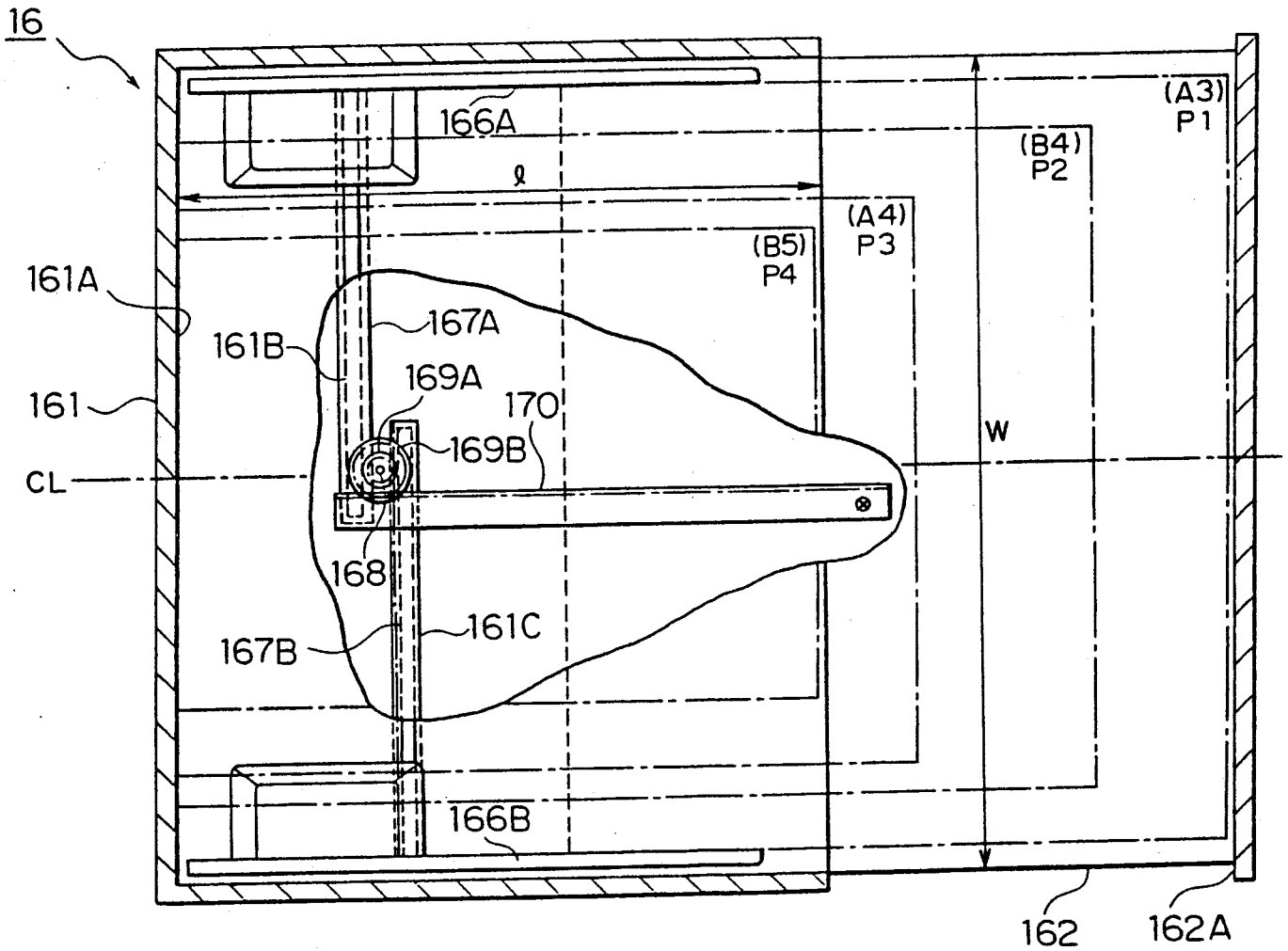
Figure 5:
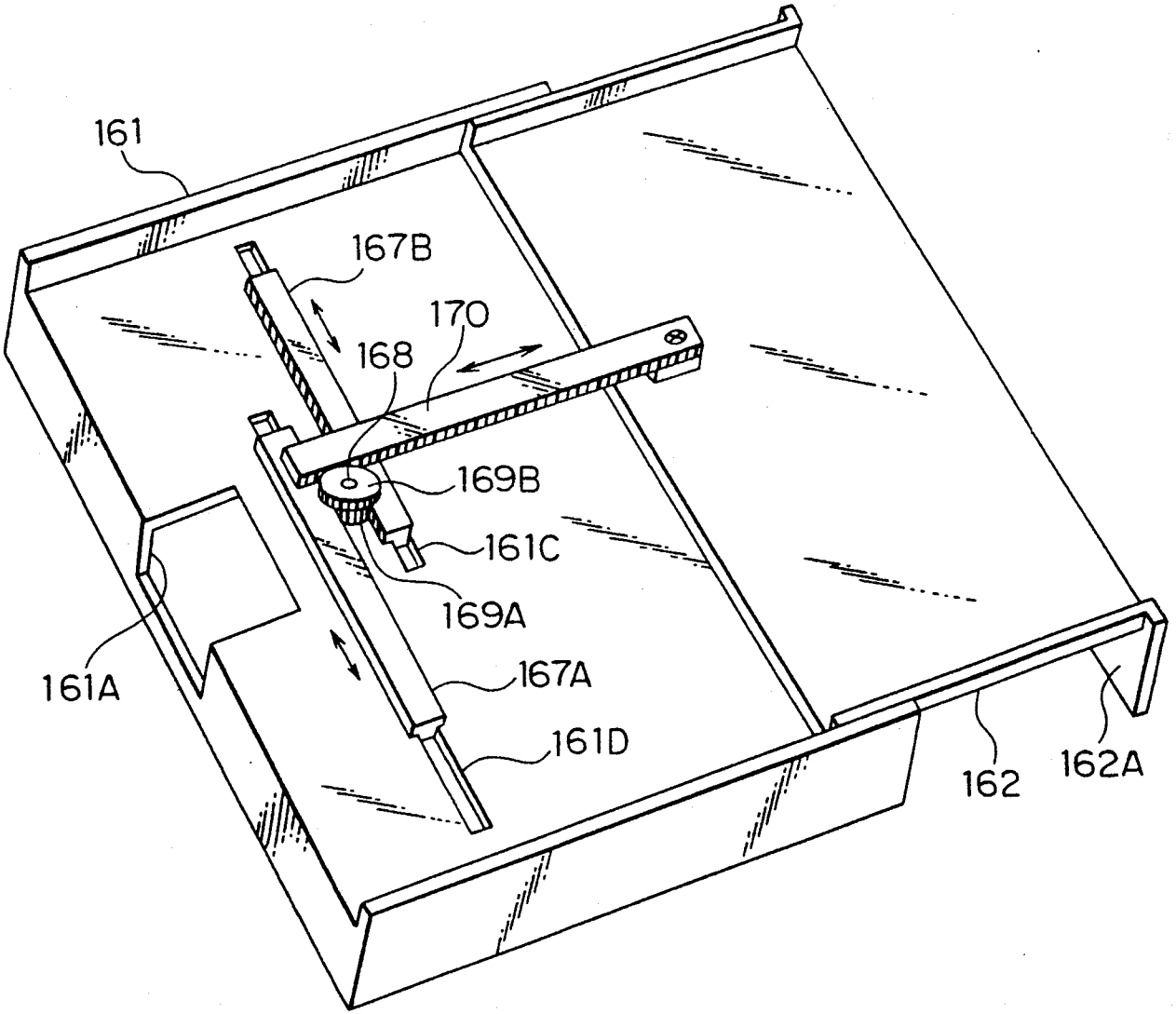
FIG. 5 is a perspective view which shows the bottom of the paper feed cassette of FIG. 4.

FIGS. 3, 4 and 5 are partially broken away plan views of another embodiment of the present invention. In FIG. 3, two long groove portions 161C and 161D are perpendicular to the paper feed direction and are located on a paper placement area on the upper surface of first casing 161. Width regulation plate 166A standing vertically on the upper side of first casing 161, and rack gear 167A on the rear side are integrally fixed and sandwiching long groove portion 161C, so that they can move along the long groove portion 161C. In the same way, width regulation plate 166B and rack gear 167B can move along the other long groove portion 161D.

Rack gears 167A and 167B mesh with rotatable pinion gear 169A which engages shaft 168 located on center line CL of the first casing. When either width regulation plate 166A or 166B is moved inwardly in a direction perpendicular to the paper feed direction the other width regulation plate, which is linked with the other regulation plate, is moved the same distance toward the center line CL.

FIG. 4 and FIG. 5 show an embodiment having means for moving second casing 162 based upon the length/width relationship of standard paper sizes; the movement of the second casing and the movement of the width regulation plates are inter connecting. In FIG. 4 and FIG. 5, pinion gear 169B having a larger pitch circle than pinion gear 169A is integral with and located on same axis 168 as pinion gear 169A, which moves the width regulation plate and can be rotated together with pinion gear 169A. Pinion gear 169B meshes with rack gear 170 which is fixed to the rear surface of second casing 162; pinion gear 169B and rack gear 170 forms the second moving device. Second casing 162 slides along a guide surface of the inner surface of first casing 161; thus, the paper placement area is expanded to accept larger papers.

Thus the first moving means which can move in the direction perpendicular to that of paper feed, and the second moving means which can move in the direction of paper feed, are interconnected. When either of the width regulation plates 166A and 166B is moved the other width regulation plate moves the same distance synchronously and symmetrically; and further, second casing 162 moves relative to first casing 161 a distance corresponding to the width/length ratio of the desired standard size paper. Specifically, in the JIS-A and JIS-B systems the ratio of the length to width thereof is about $\sqrt{2}$, therefore, the ratio of the number of teeth Z2 of pinion gear 169 B which moves second casing 162 to the number of teeth Z1 of pinion gear 169A which is rotated by movement of width regulation plates 166A and 166B, is $2\sqrt{2}$.

By setting the gear ratio in this way, when width regulation plate 166A or 166B is moved distance m in the direction perpendicular to the paper feed direction, second casing 162 moves a distance $2\sqrt{2}$ m. Accordingly, not only the width of paper P is regulated by the width regulation plates 166A and 166B, but also and at the same time, the rear half portion of paper P is stably placed in second casing 162, so that paper P is positioned between leading edge regulator 161A and trailing edge regulator 162A.

Figure 6B:
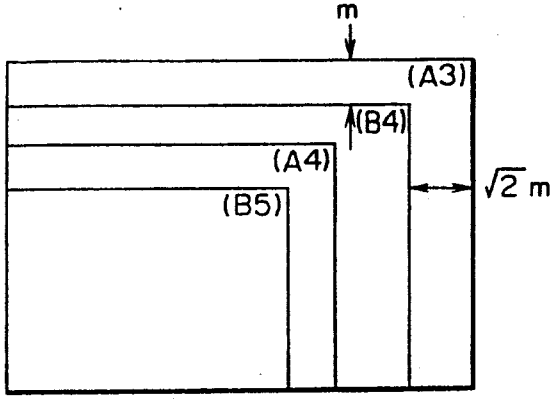
FIGS. 6 (A), 6 (B), and 6 (C) are plan views which show three alignment of standard paper sizes.
Figure 6A:
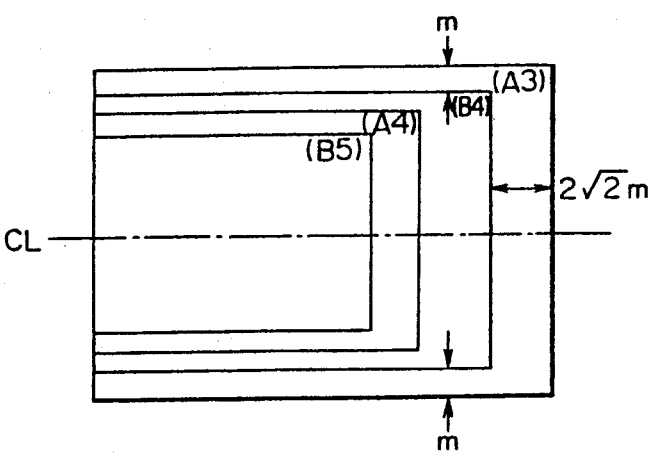
Figure 6C:
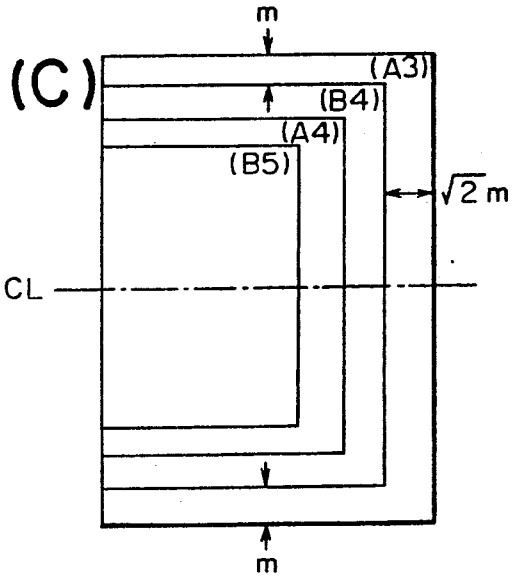

In the above embodiments, the various size papers are placed on the center of lateral position and the left and right width regulation plates are moved symmetrically by the same distance. (See FIG. 6(A).) However, as shown in FIG. 6(B), when only one of the regulation plates is moved to one side of the paper, the gear ratio of pinion gears should be set to $\sqrt{2}$. Also, as shown in FIG. 6(C), when the various size papers are placed longitudinally in the center thereof, the gear ratio of pinion gears should also be set to $\sqrt{2}$.

In the above-described embodiment, the movement of the width regulation plate and second casing is effected by meshing the rack gear with the pinion gear. However, the objects of the present invention can also be accomplished by a wire wound around a pulley; or a timing pulley combined with a timing belt; the ratio of diameters of the pulleys is $2\sqrt{2}$ or $\sqrt{2}$, depending on the orientation of the paper in the cassette.

Furthermore, instead of the manual operation, the pinion gears 169A and 169B can be driven by a motor; in that case the width regulation plates and the movable second casing can be stopped by the motor-drive at a predetermined position determined by the size of recording papers.

Figure 7A:
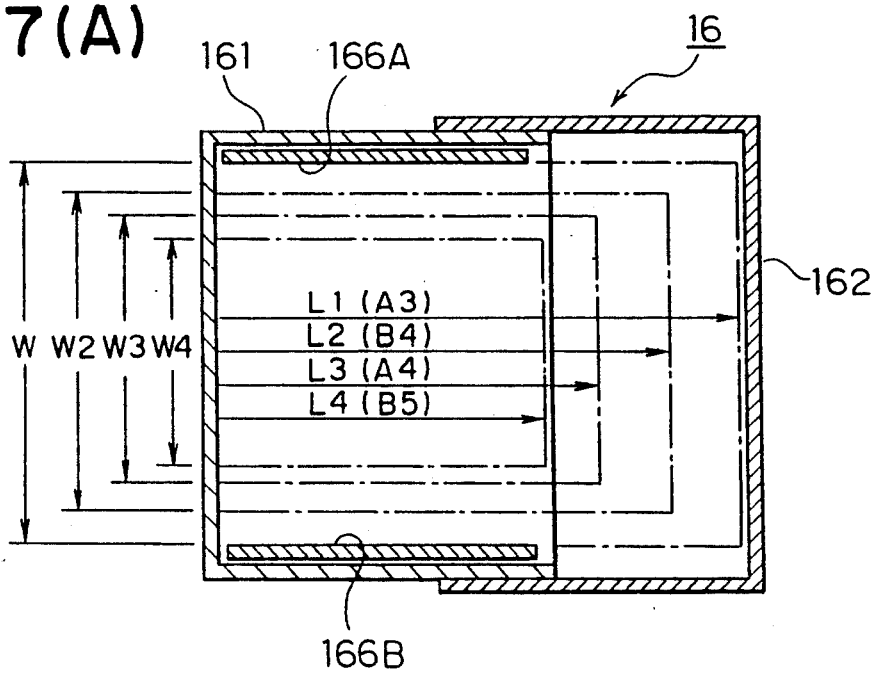
FIG. 7 (A) and FIG. 8 (A) are plan views which show a paper size indicator of the paper feed cassette of the present invention, FIG. 7 (B) and FIG. 8 (B) are its central sectional views, and FIG. 7 (C) and FIG. 8 (C) show its side views.
Figure 7B:
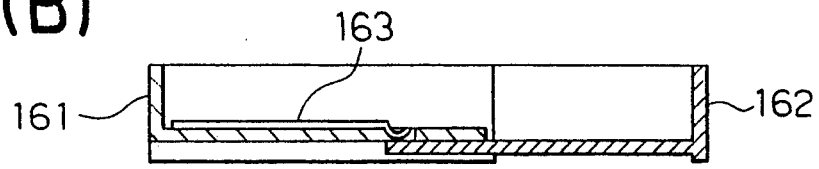

FIG. 7(A) is a plan view of paper feed cassette 16 which holds the largest-sized paper (A3 type of length L1). FIG. 7(B) is a central sectional view thereof. Second casing 162 is held by the first casing so that the second casing is pulled out to its maximum extension.

Figure 7C:
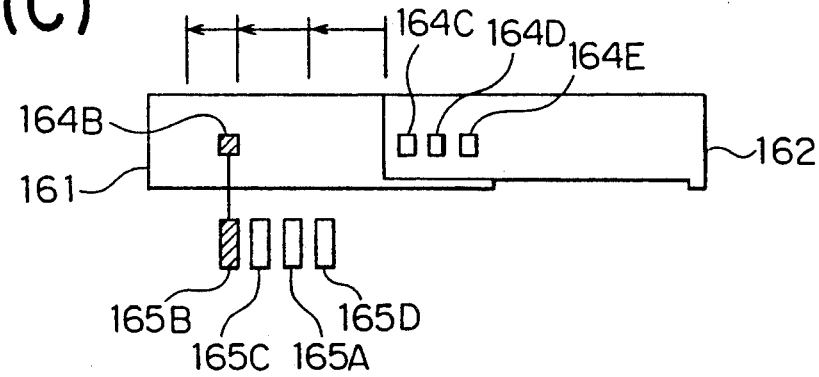

FIG. 7(C) is a side view which shows an indicator which means indicates the condition of paper feed cassette 16. The loaded status of the A3-size paper in the cassette is detected by sensor 165B when the paper size detection plate 164B, glued on the outside surface of the first casing is detected by sensor 165B.

When B4-size paper is in paper feed cassette 16, width regulation plates 166A and 166B are moved to width W2 of the B4 paper and, at the same time, the second casing is moved to length L2 in the left direction. At this time, size detection plates 164B and 164C are detected by sensors 165B and 165D.

Figure 8:
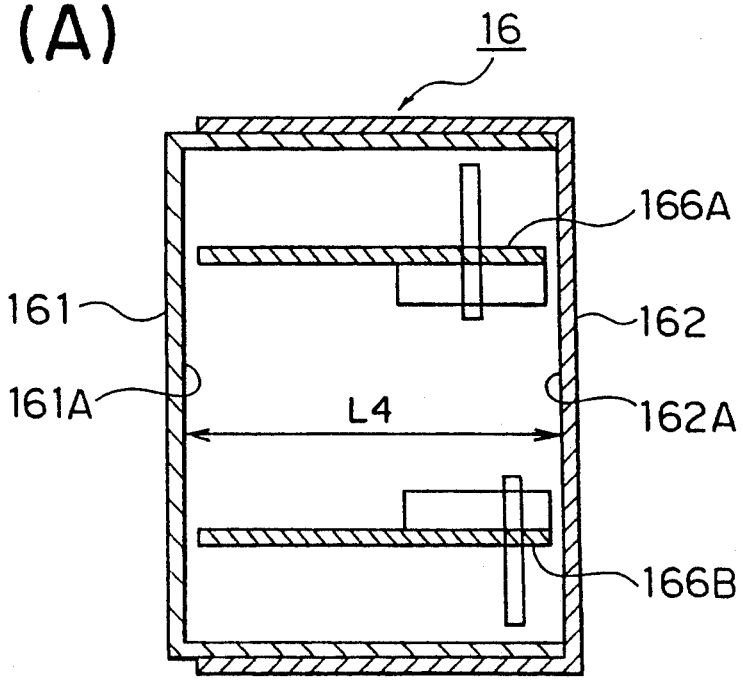
Figure 8:
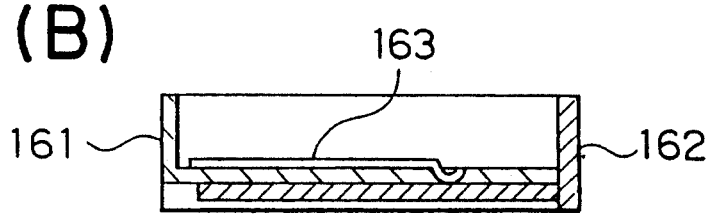
Figure 8:
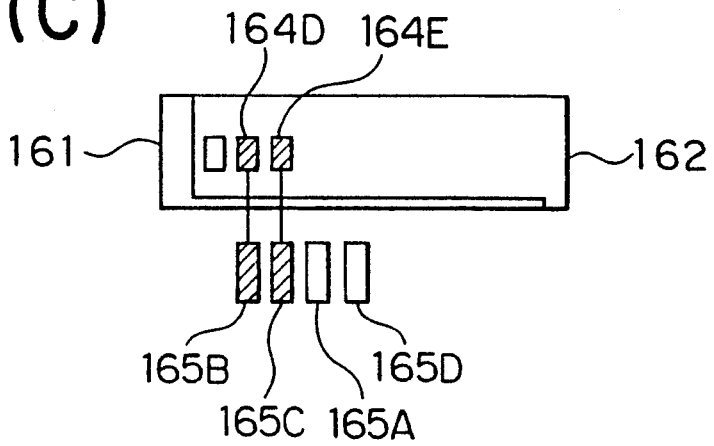

Similarly, when A4 paper is loaded, the width is set to W3 and the length is set to L3. At this time, size detection plates 164B, 164C, 164D, and 164E are detected by sensors 165B, 165C, 165A and 165D. FIG. 8(A) is a plan view of paper feed cassette 16 wherein the smallest-sized paper (for example, B5 paper of width W4 and length L4) is loaded; FIG. 8(B) is its center section, and FIG. 8(C) is a side thereof. Reflecting plate 164B of first casing 161 is covered by second casing 162, size detection plates 164D and 164E thereof are detected by sensors 165B and 165C, and the loaded paper size is recognized and can be displayed.

In the above-described embodiments, the long side of the paper has been placed in the paper feed direction. However, cassette of the present invention is equally operable if the short side of the paper is placed in the paper feed direction. Of course, appropriate adjustments of the rack and pinion gear ratio must be made.

In this way, the placement, in a lateral or longitudinal position, of papers ranging from the maximum-size A3 to the minimum-size, B5, as well as U.S.A. standard-size papers or the like, can be accomodated by enlargement and contraction of the casings and, can be easily determined by the indicators.

An example of the indicators is shown in Table 1.

(TABLE 1)

| | | Size detection plate 164 | | | |
|---|---|---|---|---|---|
| No. | Paper size | A | B | C | D |
| 1 | B4 | ○ | ○ | ○ | ○ |
| 2 | B5R | ○ | ○ | ○ | |
| 3 | B5 | ○ | ○ | | ○ |
| 4 | B6 | ○ | ○ | | |
| 5 | A3 | ○ | | ○ | ○ |
| 6 | A4R | ○ | | ○ | |
| 7 | A4 | ○ | | | ○ |
| 8 | Post card | ○ | | | |
| 9 | 8.5" × 14" | | ○ | ○ | ○ |
| 10 | F4 | | ○ | ○ | |
| 11 | | | ○ | | ○ |
| 12 | 5.5" × 11R" | | ○ | | |
| 13 | 11" × 17" | | | ○ | ○ |
| 14 | 8.5" × 11R" | | | ○ | |
| 15 | 8.5" × 11" | | | | ○ |

Since the universal paper feed cassette according to the present invention can enlarge and contract to accept various paper sizes, when the cassette is mounted on the main body of the image recording apparatus, the amount of protrusion from the front or the side of the apparatus is at a minimum. Thus, the installation area can be minimized, and impact and damage due to the cassette protrusion rarely occurs.

Furthermore, the paper feed cassette according to the present invention can position the trailing edge of the paper concurrently with the width arrangement of the paper since the movable second casing moves forward and backward, being linked with the movement of the paper width regulation plate. Or, the cassette can easily be set to a predetermined paper width by operating the movable second casing since they are linked.

Since the paper placement area determined by the width and length of the paper can be set automatically by either of the movement of the paper width regulation plates or of the second casing, two motions can be accomplished at the same time by a single operation. Thus, operability is improved, and problems such as defective paper arrangement have been minimized.

Moreover, since various sizes of papers loaded in the universal paper feed cassette can easily be detected by the enlargement and contraction of the cassette casings at the time of mounting the paper feed unit, wasteful recording due to the failure of selection of the proper paper size can also be minimized.

What is claimed is:

1. A sheet feed cassette for holding various sizes of sheets to be fed to an image recording apparatus in a feed direction, said cassette comprising:

a first casing having a sheet placement area, a second casing slidably connected to the first casing for expanding the area, said first casing being detachably mounted on said image recording apparatus, a width regulator for regulating placement of said sheets in a perpendicular direction to said feed direction, wherein the width regulator comprises a pair of width regulation plates, said plates being slidable in said perpendicular direction, a first moving device for moving the pair of plates symmetrically and simultaneously, a second moving device for moving the second casing in cooperation with the first moving device so that each of said width regulator and said second casing moves a predetermined distance simultaneously when either one of said width regulator or said second casing is moved, wherein the first moving device comprises a first rack gear and a first pinion gear, and the second moving device comprises a second rack gear and a second pinion gear, wherein said first rack gear engages said first pinion gear, and the first pinion gear and the second pinion gear have a common axis of rotation.

2. The cassette of claim 1 wherein a gear ratio of the first pinion gear to the second pinion gear is based on a ratio of a longer side length and a shorter side length of a standard size paper.

3. A sheet feed cassette for holding various sizes of sheets to be fed to an image recording apparatus in a feed direction, said cassettes comprising a casing having a sheet placement area on which a pile of sheets is placed;

a width regulating plate to regulate placement of the sheets in a width direction which is perpendicular to a sheet feed direction;

a first moving device to move the width regulating plate, including a first rack gear and a firs pinion gear;

a back edge regulating plate to regulate placement of the sheets in the sheet feed direction; and a second moving device to move the back edge regulating plate including a second rack gear and a second pinion gear;

wherein the first pinion gear and the second pinion gear have a common axis of rotation so that each of said width regulating plate and said back edge regulating plate moves a predetermined distance simultaneously when one of said width regulating plate or said back edge regulating plate is moved.

4. The cassette of claim 3 wherein a gear ratio of the first pinion gear to the second pinion gear is determined based on a ratio of a longer side length and a shorter side length of a sheet of standard size paper.

5. The cassette of claim 3 wherein said casing comprises a first casing detachably mounted in said image recording apparatus and a second casing slidably connected to said first casing for expanding the sheet placement area, and said second moving device moves said second casing to function as said back edge regulating plate.

* * * * *